US006591462B2

(12) United States Patent
Fuhrman

(10) Patent No.: US 6,591,462 B2
(45) Date of Patent: Jul. 15, 2003

(54) MAGNETIC JEWELRY CLASP WITH SAFETY CATCH

(76) Inventor: Esther Fuhrman, 600 Harbor Blvd. - Suite 1022, Weehawken, NJ (US) 07087-6741

( * ) Notice: Subject to any disclaimer, the term of this patent is extended or adjusted under 35 U.S.C. 154(b) by 0 days.

(21) Appl. No.: 09/968,835

(22) Filed: Oct. 2, 2001

(65) Prior Publication Data

US 2003/0061689 A1 Apr. 3, 2003

(51) Int. Cl.[7] ..... A44B 21/00
(52) U.S. Cl. ..... 24/303; 24/DIG. 52
(58) Field of Search ..... 24/303, DIG. 52; 63/3.1

(56) References Cited

U.S. PATENT DOCUMENTS 1,441,999 A * 1/1923 Posner ..... 24/616
1,807,293 A * 5/1931 Keller ..... 24/616
5,008,984 A * 4/1991 Levy ..... 24/303
5,197,168 A * 3/1993 Levy ..... 24/303
5,311,647 A * 5/1994 Levy ..... 24/303
5,317,789 A * 6/1994 Levy ..... 24/303
5,349,725 A * 9/1994 Levy ..... 24/303
5,367,891 A * 11/1994 Furuyama ..... 63/29.2
5,664,298 A * 9/1997 Nessar-Ivanovic ..... 24/303

FOREIGN PATENT DOCUMENTS

EP 462072 A1 * 12/1991

* cited by examiner

*Primary Examiner*—James R. Brittain
(74) *Attorney, Agent, or Firm*—Gibbons, Del Deo, Dolan, Griffinger & Vecchione

(57) ABSTRACT

A jewelry clasp is provided with two bodies, each having a surface magnetically attracted to the other. The clasp has a safety catch that includes an arm hinged to one of the bodies. The arm may be swung about the hinge between an open position and a closed position. A further magnetic attraction keeps the arm in the closed position until opened with a fingernail. A retaining wall may extend generally perpendicular to a direction of elongation of the arm to block a path that the other of the bodies could travel if the bodies were to separate from each other while the safety catch is in the closed position. If desired, a male connector may be inserted into a female connector to prevent separation of the bodies from each other. The male connector and female connector are usable in tandem with the retaining wall, or in lieu thereof.

22 Claims, 12 Drawing Sheets

MAGNETIC JEWELRY CLASP WITH SAFETY CATCH

BACKGROUND OF THE INVENTION

1. Field of the Invention

The invention relates generally to jewelry and more particularly to a magnetic jewelry clasp with a safety catch. While the jewelry clasp is magnetic, the catch may or may not be magnetic. The clasp may include a retaining wall or other device to help retain the safety catch in a closed position.

2. Discussion of Related Art

A conventional jewelry clasp is connected to links of a necklace, bracelet, ankle bracelet or belly chain. By opening or closing the mechanical clasp, the jewelry can be either removed from or secured on the wearer. A second clasp or "safety catch" is sometimes provided. This is especially true for more expensive jewelry. A conventional safety catch is also a mechanical connection.

A magnetic jewelry clasp includes two bodies that are held together by magnetic attraction and released from each other by pulling them apart to break the magnetic attraction. Thus, the bodies are movable between a connected condition (when together) and a separated condition (when pulled apart).

The inventor is unaware of a magnetic jewelry clasp which also employs a safety catch. This is probably due to the fact that conventional magnetic clasps do not limit the position for connecting the two sides of the clasp. Thus, while employing a safety catch with conventional magnetic jewelry clasps would add the benefit of added security, it would also eliminate an advantage offered by such clasps by requiring a user to properly align the sides of the clasp for the clasp to be closed. The inventor is also unaware of any magnetic safety catches.

The making and breaking of a magnetic attraction force between the two portions of the clasp renders the magnetic jewelry clasp easy to use. However, it would be beneficial to make the clasp more secure by adding a safety clasp (magnetic or mechanical). Additionally, it would be desirable to make the safety catch easier to use and yet still resist forces that might otherwise break the magnetic attraction force between the two sides of the clasp.

SUMMARY OF THE INVENTION

To improve upon the conventional jewelry clasp, the invention provides a magnetic jewelry clasp with a safety catch. The clasp includes two bodies movable between a separated condition and a connected condition. Each of the two bodies has at least one magnetically attractive surface that is attracted to the other in the connected condition. At least one of the magnetically attractive surfaces is formed by a magnet. The other may be a magnet or a magnetically attracted material. The two bodies are arranged to move into the separated condition in response to manual forces that pull the two bodies apart to break the magnetic attraction between the surfaces. The invention also includes a safety catch, connected to one of the two bodies, that includes an arm movable between a catch position and a release position. The safety catch may be magnetic or conventional.

The arm is hinged to one of the bodies and has a free end that may be moved between a catch position and a release position. In the catch position, the arm may be in magnetic attraction with one of the two bodies in accordance with one embodiment or with the magnetic connection between the two bodies in accordance with another embodiment. The arm may be in magnetic attraction with one of the magnets in one of the bodies in an embodiment and/or the arm may be conventionally connected to one of the bodies.

While the arm is in the release position, there may be blocking surfaces that no longer abut even though the two bodies are still magnetically connected to each other. While the arm is in the catch position, the blocking surfaces abut to resist forces that otherwise would tend to pull the bodies apart and break the magnetic attraction between the bodies. These blocking surfaces may also be magnetically attracted to each other.

The arm may enter the release position from the catch position by using the user's fingernail to flick a free end of the arm in a direction that breaks the magnetic attraction between the arm and the one of the two bodies. Once the safety catch is released, the two bodies may be pulled apart by breaking the magnetic connection between the surfaces that face each other. To close the jewelry clasp, the two bodies are brought together so as to establish the magnetic connection and then the safety catch is secured.

DETAILED DESCRIPTION OF THE INVENTION

Figure 1:
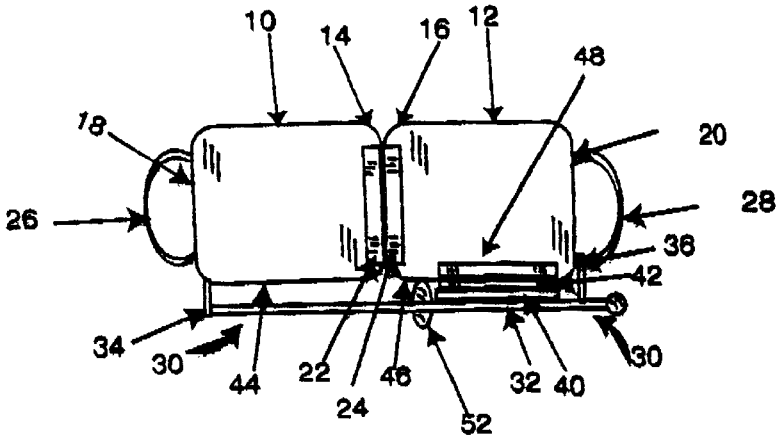
FIG. 1 shows a side elevation view of a jewelry clasp in accordance with the present invention with a safety catch secured with its arm in a closed position.

Turning to the drawings, FIGS. 1, 2, 2*a*, 2*c*, 2*d*, 3, 6, 9, 10, 13 and 14 show two bodies 10, 12 of a jewelry clasp. The main bodies have connection surfaces 14, 16, that face each other and have opposite surfaces 18, 20 that face away from each other. As seen in FIGS. 1, 2, 2*a*, 2*c*, 2*d*, 3, 6, 9, and 13 each of the connection surfaces 14, 16 is shown with a magnet 22, 24 so that the connection surfaces 14, 16 of the bodies 10, 12 are magnetically attracted to each other when brought together face to face. Those skilled in the art will recognize that only 1 of the magnets is necessary and that the other magnet may be eliminated if the other face is made of a magnetically attracted material. They will also recognize that if both connection surfaces 14, 16 include magnets that the magnets could be configured with north and south poles such that when the two surfaces are brought together they align to the same orientation every time. As seen in FIGS. 1, 2*a*, 3, 6, 8, and 9 each of the opposite surfaces 18, 20 has a half ring 26, 28 that is used to connect with a necklace or a bracelet or other jewelry chain links (not shown) in a conventional manner.

Figure 2:
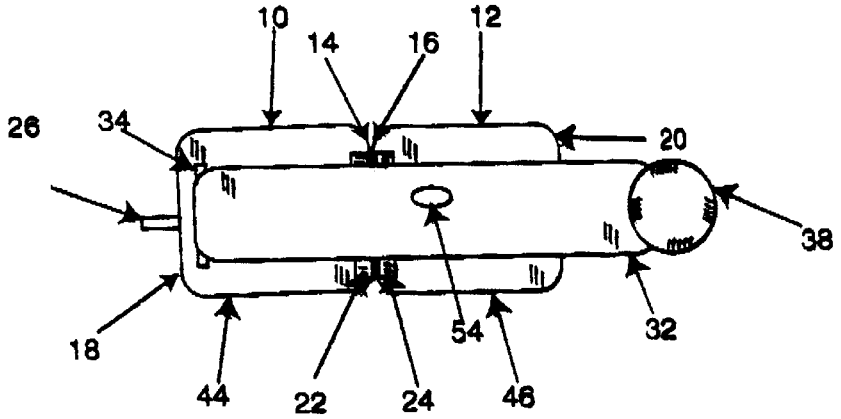
FIG. 2 shows a bottom plan view of FIG. 1.
Figure 2A:
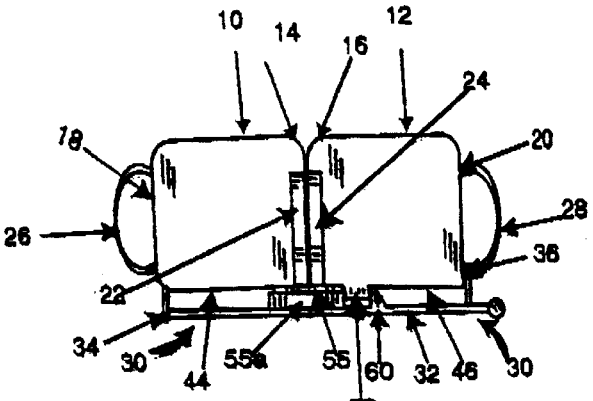
FIG. 2*a* shows a side elevation view of an additional embodiment.
Figure 2B:
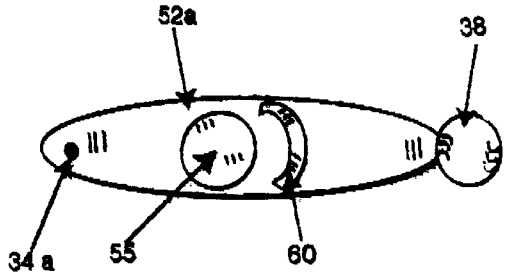
FIG. 2*b* shows a top plan view of the arm in accordance with the additional embodiment of FIG. 2*a;*
Figure 3:
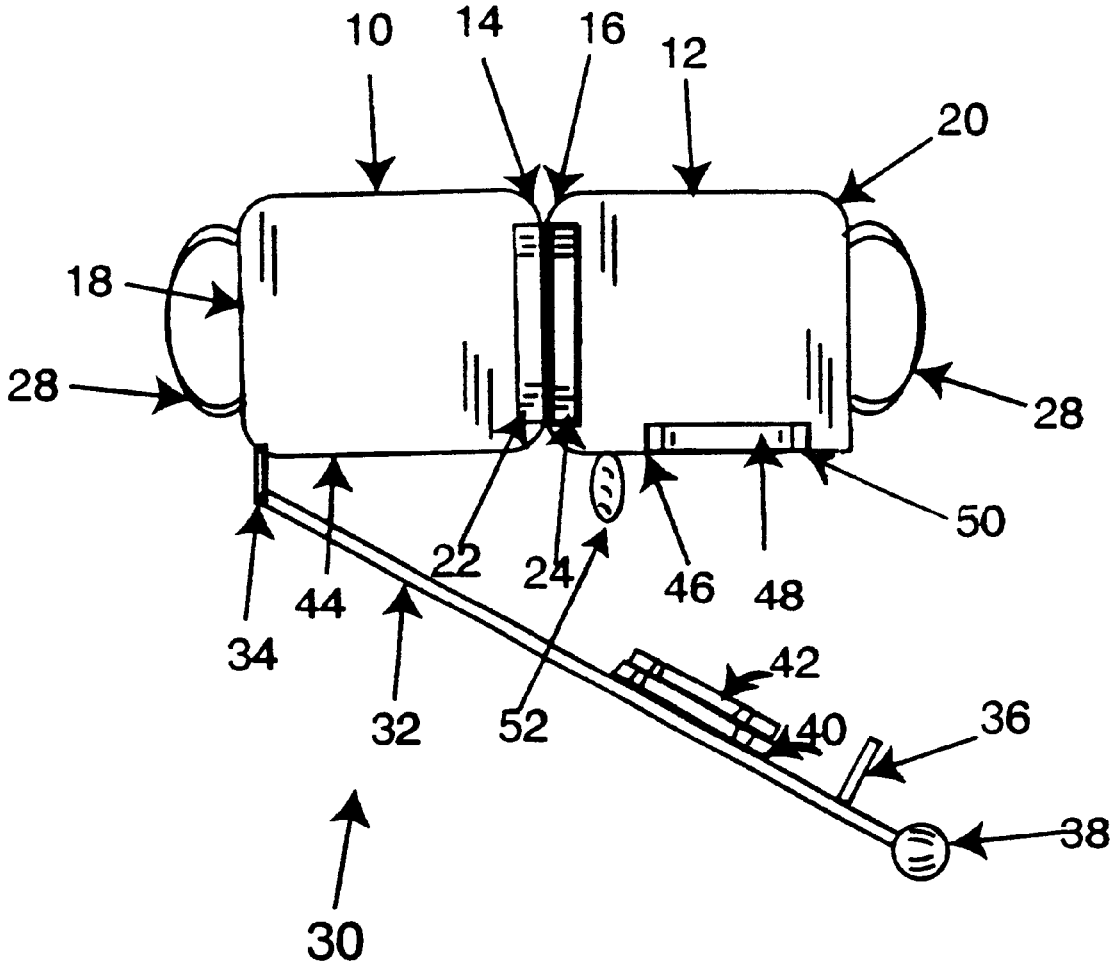
FIG. 3 shows a side elevation view as in FIG. 1, but with the safety catch released with its arm in an open position.
Figure 4:
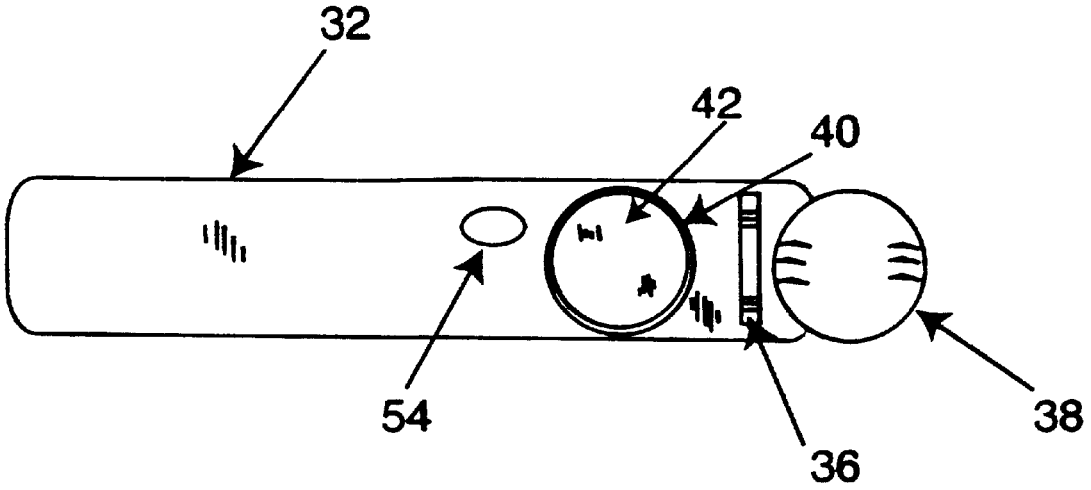
FIG. 4 shows a top plan view of the safety arm of FIG. 1.
Figure 5:
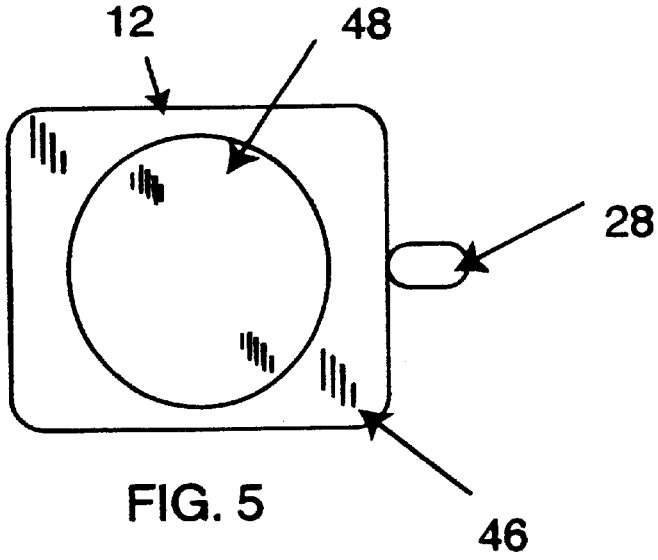
FIG. 5 shows a bottom plan view of one of the two bodies of FIG. 1 with a magnet on the bottom surface.
Figure 13:
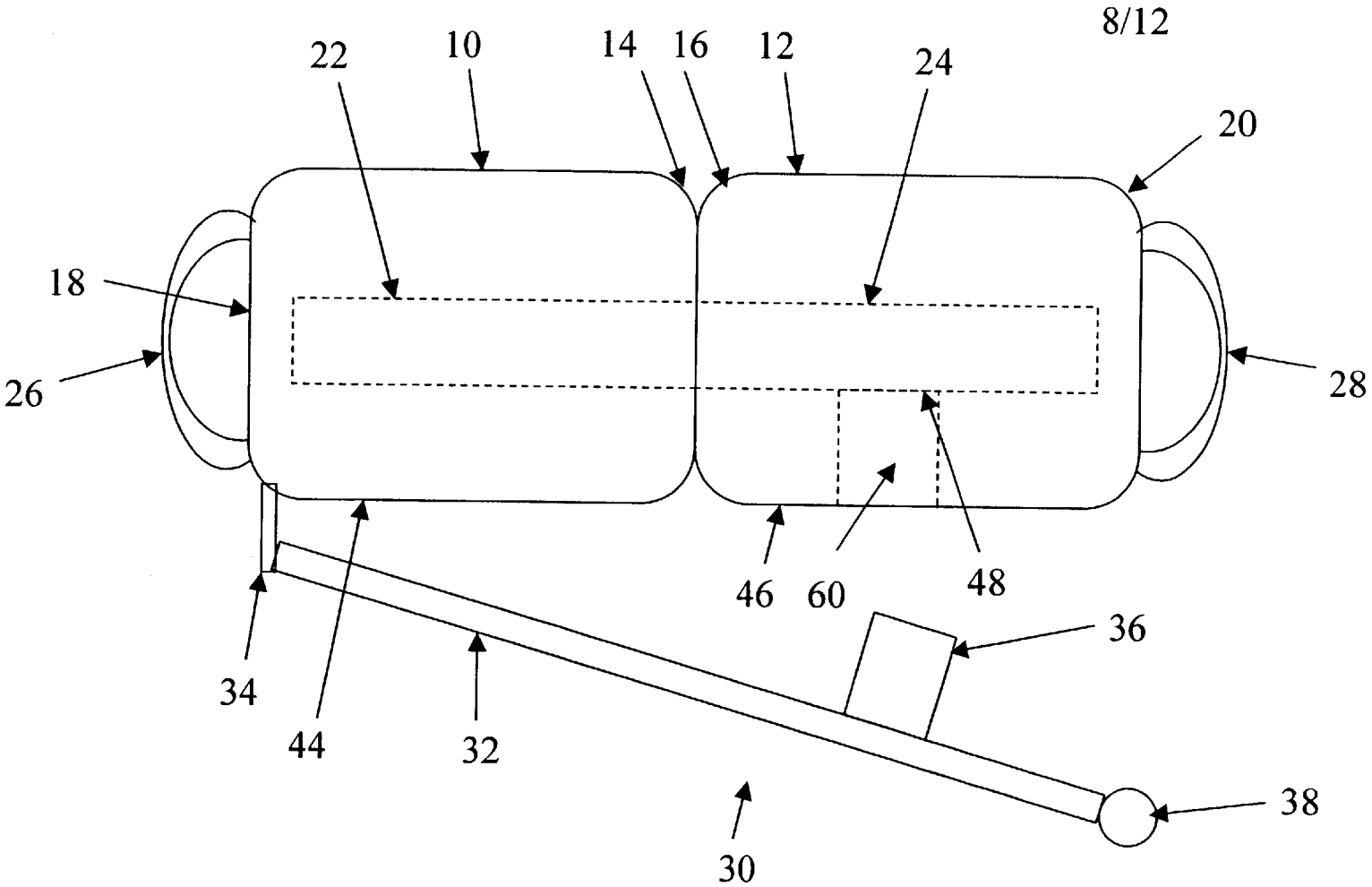
FIG. 13 shows a side elevation view of another alternate embodiment of a jewelry clasp in accordance with the present invention with a safety catch released with its arm in an opened position.
Figure 14:
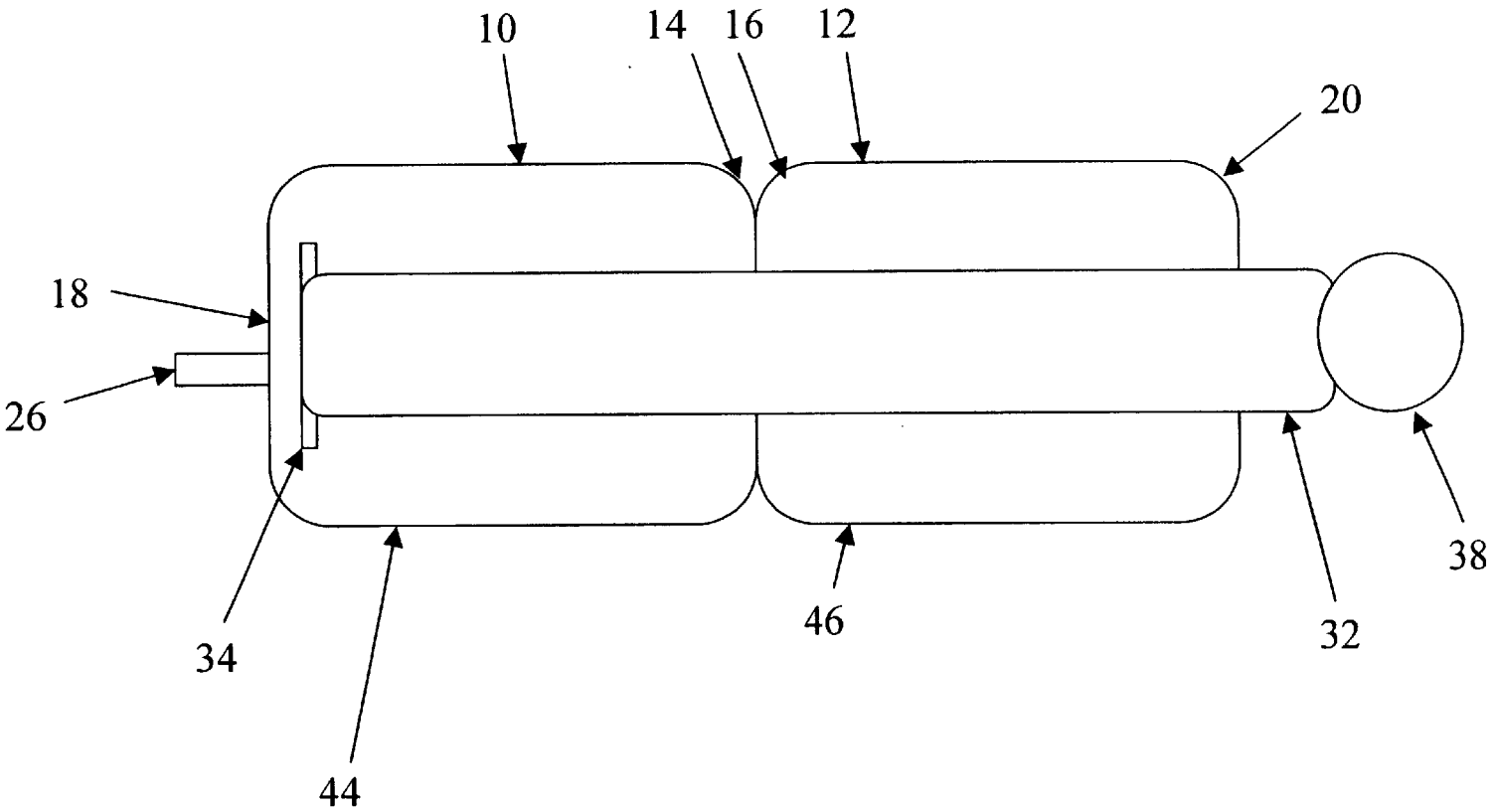
FIG. 14 shows a bottom plan view of FIG. 13.
Figure 15:
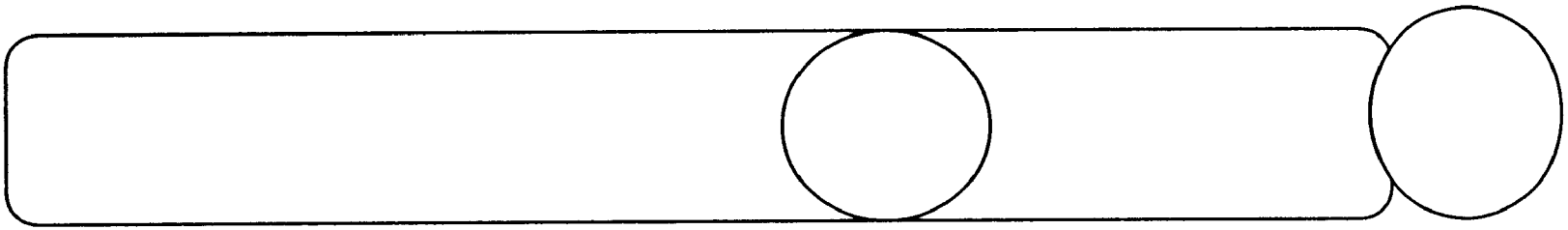
FIG. 15 shows a top plan view of the safety arm of FIG. 13.
Figure 16:
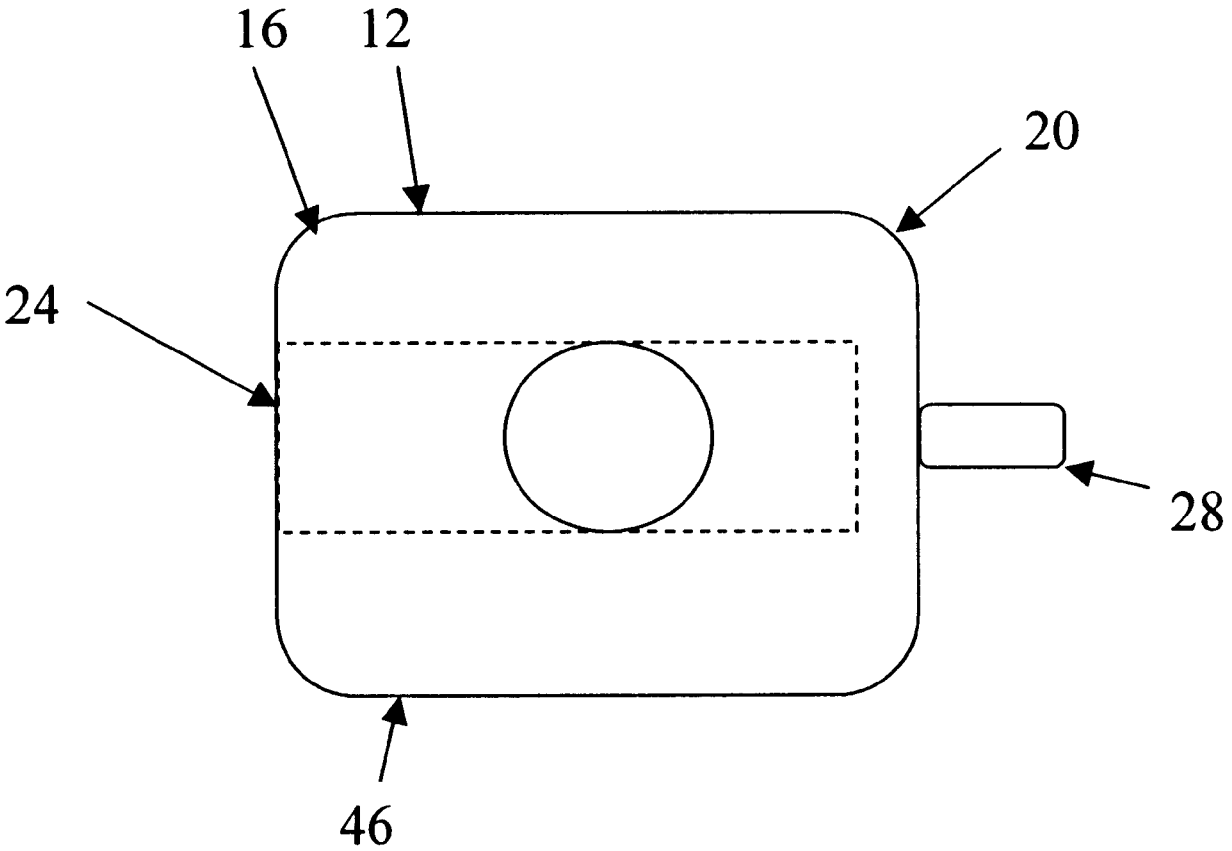
FIG. 16 shows a bottom plan view of one of the two bodies of FIG. 13 with the magnet open to the bottom surface.
Figure 17:
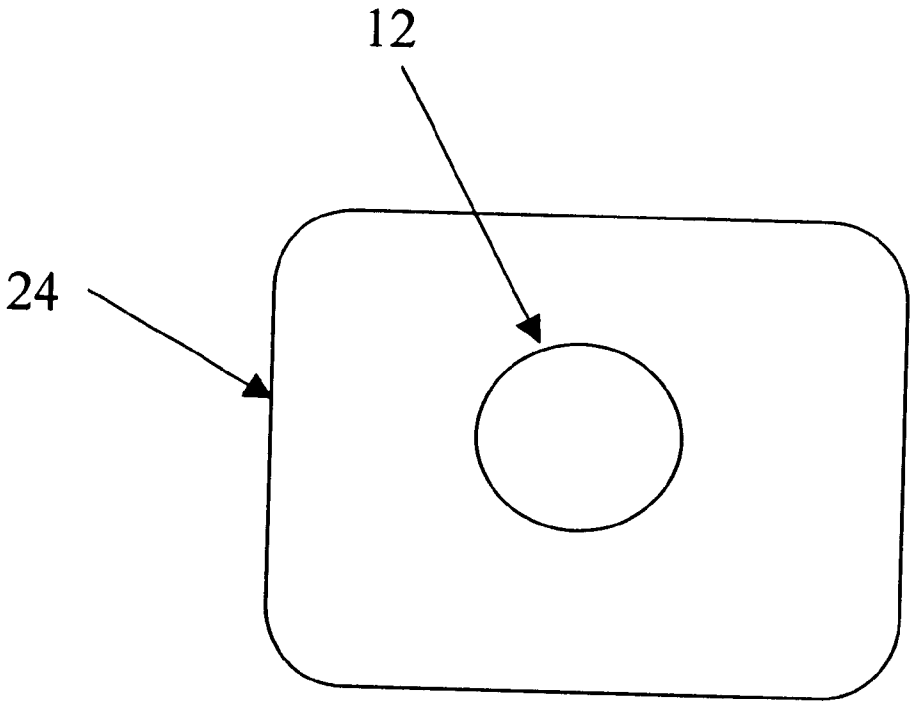
FIG. 17 shows a front plan view of either of the bodies of FIG. 13, as viewed when looking at the magnet.

FIGS. 1, 2*a*, 2*b*, 3, 4 and 9 show a safety catch 30, which includes an arm 32, a hinge 34, a retaining wall 36, a ball 38, a magnet holder 40 and a magnet 42. The hinge 34 is secured to body 10. The arm 32 is connected to the hinge 34 at one end, and also has a free end at which is located the ball 38. The arm 32 is rotatable about the hinge 34 between a release position clear of the body 12, as shown in FIG. 3, and a catch position adjacent bottom surfaces 44, 46 of bodies 10, 12, as shown in FIGS. 1 and 2. The arm may be considered to be a thin and narrow paddle with flat opposite sides. Rotation of the arm 32 may be to the extent necessary (i.e., up to and including 360 degrees) to the particular design. FIG. 13 illustrates an alternate design for the safety catch 30. This design includes the retaining wall 36 (*also referred to as a blocking surface) but not the magnet 42 or magnet holder 40. However, those skilled in the art will recognize that retaining wall 36 could be replaced by magnet 42 and magnet holder 40 without departing from the scope of the invention.

The bottom surface 46 of the body 12 has a magnet 48. When the arm 32 is in the catch position, the magnet 42 and the magnet 48 have faces that contact each other and are magnetically attracted. The magnet 42 is held in a holder 40, which is secured to a flat side of the arm 32 at a location so that when the arm 32 is rotated about the hinge 34 to be neighboring the bottom surfaces 44, 46, faces of the magnets 42, 48 contact each other. Those skilled in the art will recognize that the holder may not be required and that one of the magnets could be replaced by a metal such as steel, iron or the like.

The retaining wall 36 extends from the arm 32, preferably in a direction perpendicular thereto, to lie against a rear surface 20 of the body 12 when the arm 32 is in the catch position, as shown in FIG. 3. When the arm 32 is in such a catch position, the retaining wall 36 is in the most likely path that the body 12 would travel to separate from the body 10. Also, magnetic attractive surfaces 42, 48 of the arm 32 and the body 12 are in contact with each other to effect a magnetic connection therebetween. The retaining wall 36 blocks the two bodies 10, 12 from inadvertently moving apart from each other. The blocking force exerted resists such movement because the opposite end of the arm 32 is secured by the hinge connection 34 to the body 10. Such a blocking force is in addition to the magnetic attraction afforded by the magnets 42, 48, 22 and 46 that also resist movement of the bodies 10, 12 away from each other.

Figure 6:
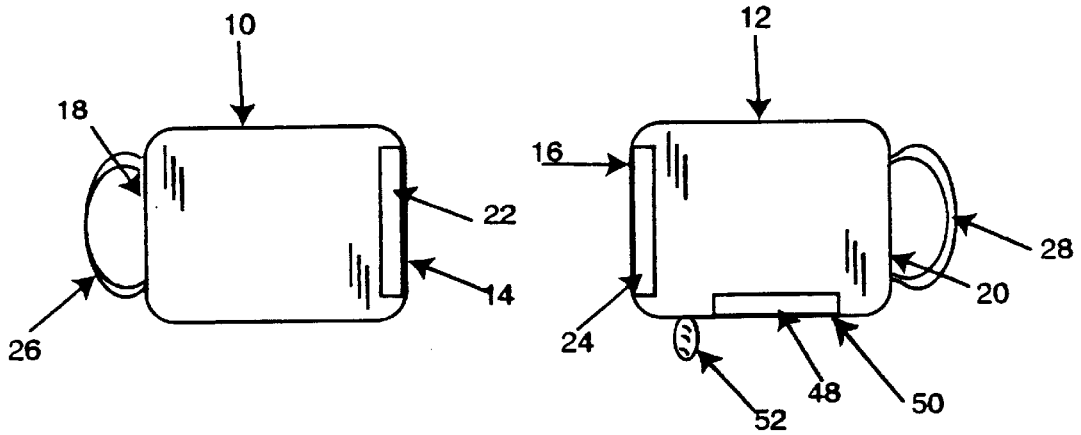
FIG. 6 shows a side elevation view of the two bodies separated from each other, but without showing the safety catch.

In addition, when the arm 32 is in the closed or catch position, the ball 38 is beyond a periphery of the body 12. To open the safety catch 30 from the position shown in FIGS. 1 and 2, one need only place one's fingernail against the ball 38 and move the ball 38 in a direction away from the body 12 that will separate the magnets 42, 48 from each other. Thus, the two bodies 10, 12 are grasped in one hand while the ball is moved with the other hand. In other words, the safety catch 30 may be released by moving the arm 32 from a catch position to the release position. In the release position, the retaining wall 36 is clear of the path and the magnetic connection is broken between the magnetically attractive surfaces 42, 48 of the arm 32 and the body 12. Once the safety catch is open, pulling apart the two bodies 10, 12 to break the magnetic attraction between them will result in a separated condition of the bodies, as shown in FIG. 6.

While the two bodies 10, 12 are shown to have cubic shapes in the drawings, they may be configured instead to have any other geometric shape. For instance, instead of having a circular cross-section, it may be rectangular, square, trapezoidal, pentagonal, hexagonal, octagonal or any other polygonal shape. The shape of the magnet 48 may be changed accordingly to suit. Further, while the arm 32 is magnetically attracted to the clasp it need not be.

Figure 7:
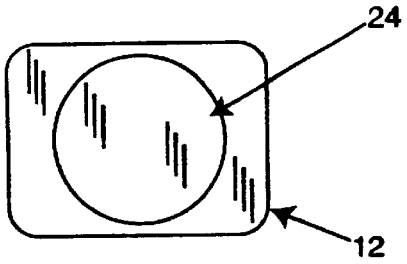
FIG. 7 shows a front plan view of either of the bodies of FIG. 6, as viewed when looking at the magnet.
Figure 8:
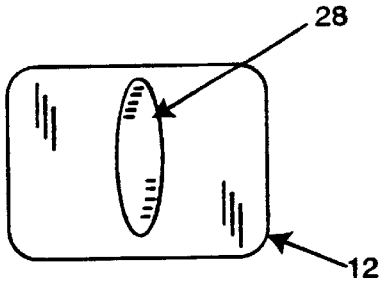
FIG. 8 shows a rear plan view of either of the bodies of FIG. 6, as viewed when looking at the half ring to attach to necklace or other jewelry chain links.
Figure 9:
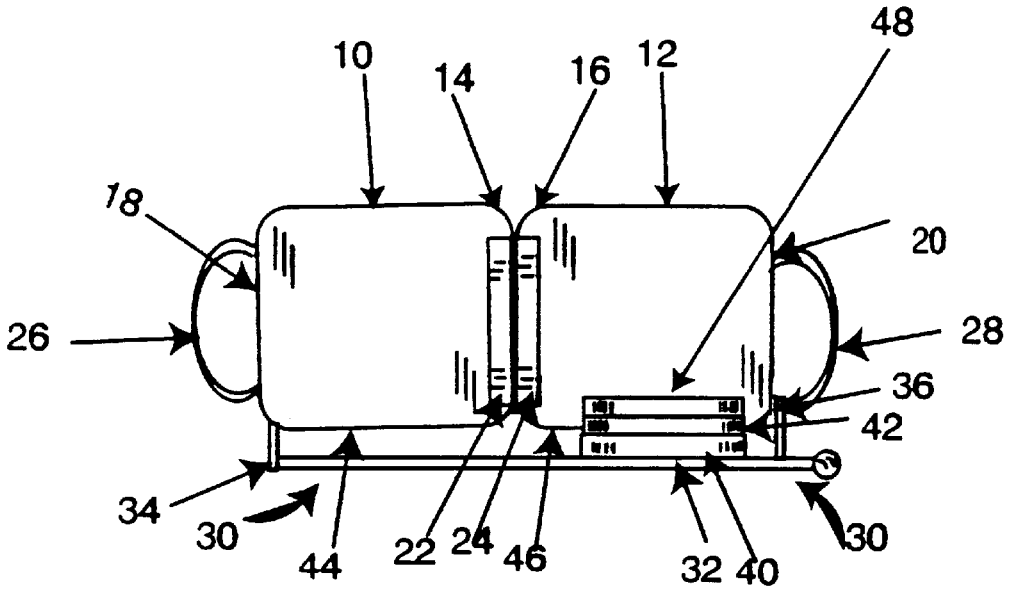
FIG. 9 shows a side elevation view of an alternate embodiment of a jewelry clasp in accordance with the present invention with a safety catch secured with its arm in a closed position.
Figure 10:
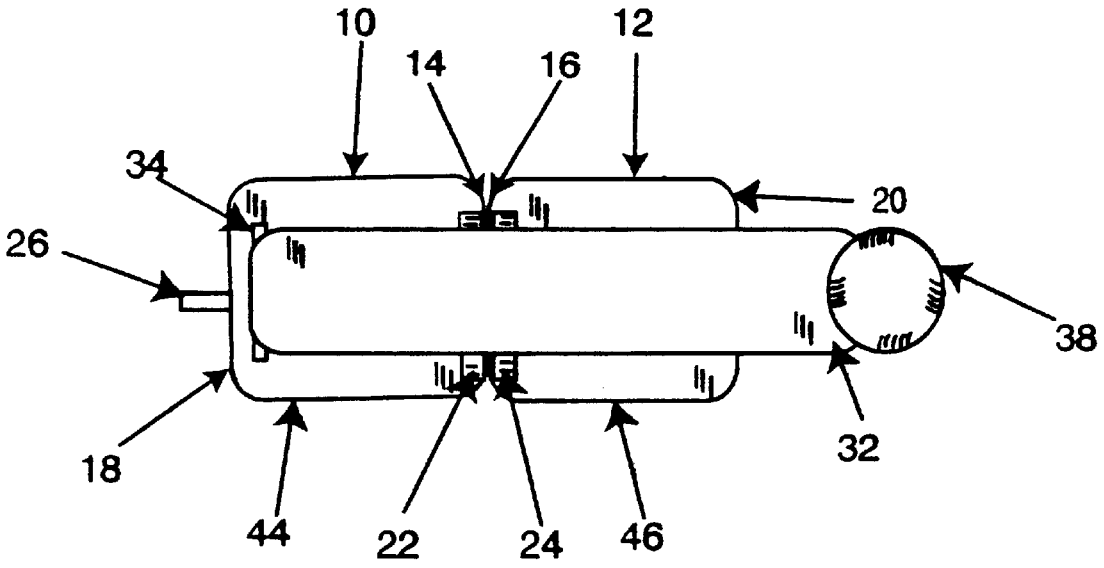
FIG. 10 shows a bottom plan view of FIG. 9.
Figure 11:
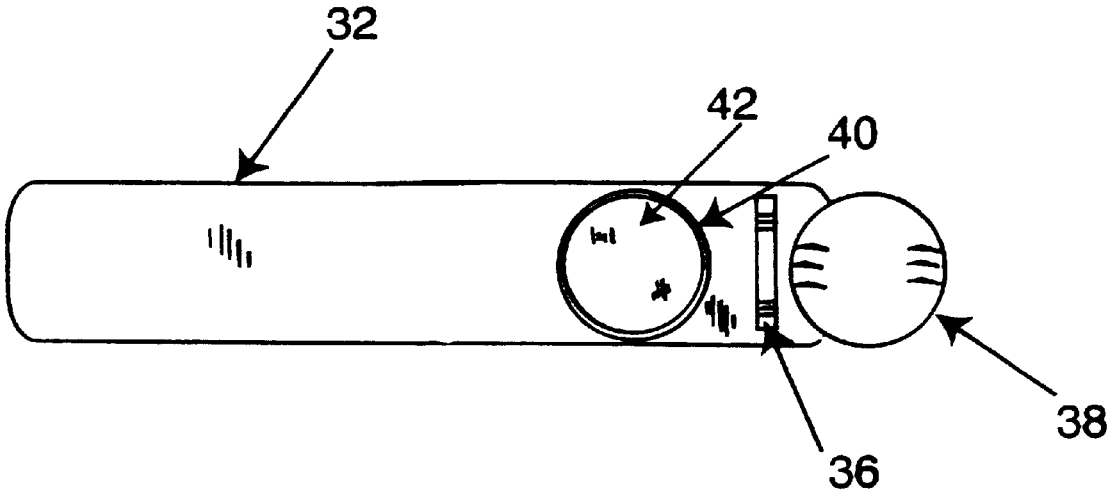
FIG. 11 shows a top plan view of the safety arm of FIG. 9.
Figure 12:
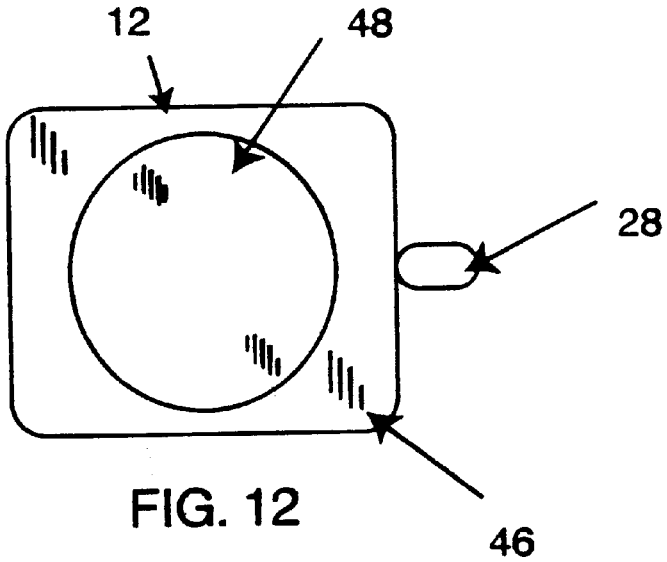
FIG. 12 shows a bottom plan view of one of the two bodies of FIG. 9 with a magnet on the bottom surface.

The magnets 22, 24 and the magnets 42, 48 each may be cylindrical with a circular cross-section, as shown in FIG. 7, or may have any other geometric shape needed to best accomplish closure of the jewelry clasp. The clasp may be made out of any material or combination of materials so long as the connection surfaces 14, 16 of the two bodies 10, 12 are magnetically attracted to each other. The arm 32 may also be magnetically attracted to the bottom surface 46 of at least one of the bodies 10/12. For example, if the jewelry clasp is made of an expensive metal, i.e., gold, silver, platinum or titanium, then both pairs of magnets 22, 24 and 42, 48 may be employed for additional protection. If, however, the clasp is made of fashion metals, each of the pairs of magnets 22, 24 and 42, 48 on their respective connection surfaces may be replaced by one magnet, on one of the connection surfaces, provided the other of the connection surfaces to which the magnet contacts in the closed position is made of a magnetically attractive metal itself, such as iron, steel, etc.

The magnet 42 may be secured to its magnet holder 40 with an adhesive. Likewise, the magnet 48 may be secured to the body 12 with an adhesive. It may also be secured within a recess 50 formed in the body 12. To help keep the magnets from dislodging over time due to the adhesive losing its adhesive strength, the outer periphery of the recess 50 and the magnet holder 40 may be bent inwardly or a metal rim added to extend inwardly from the outer peripheries. Preferably, at least one half of the outer peripheries will have this inward bend or metal rim, under which is placed the respective magnet edge. Such a configuration prevents dislodgment of the magnet 42 from the magnet holder 40 or the magnet 48 from the recess 50. Likewise, the peripheries of recesses that contain the magnets 22, 24 may be bent in the same manner or a metal rim added to protrude inwardly. Preferably, at least one half of the periphery has the metal rim or bent portions.

Instead of rotating the arm 32 about a hinge 34 connection, provision may be made to replace the hinge 34 connection by a guide groove to permit the arm 32 to slide between the catch and release positions (not shown). In such a construction, outwardly directed projections may be provided on the arm 32 spaced from either end of the guide groove to prevent the arm 32 from sliding entirely out of the guide groove. Further, the guide grooves may each have a lip that extends toward each other to either cover the arm 32 or define a gap therebetween that is smaller in dimension that the width of the arm 32.

Figure 2C:
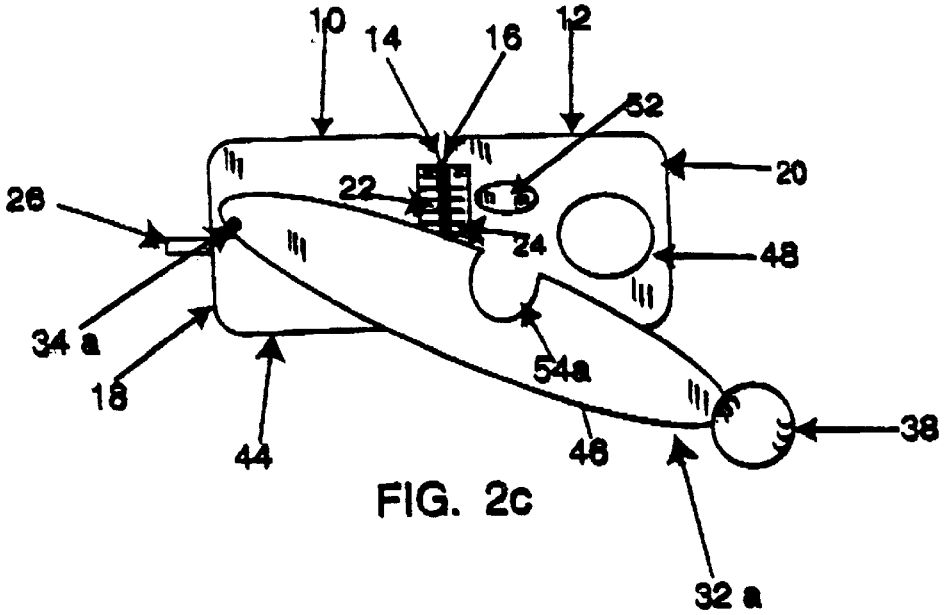
FIG. 2*c* shows a bottom plan view of another embodiment with a safety catch in an open condition.
Figure 2D:
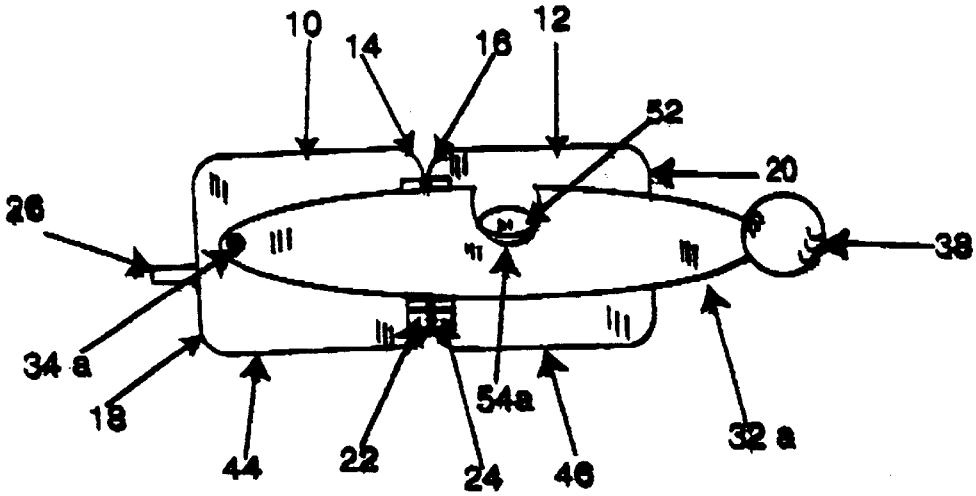
FIG. 2*d* shows the embodiment of FIG. 2*c*, but with the arm of the safety catch secured in a closed condition.

As an alternative, the hinge 34 connection may remain, but the hinge 34 may be modified to allow the arm 32 to rotate in a plane parallel to the adjacent surface of the body 10 as opposed to rotating in a plane transverse thereto (FIG. 2*c*).

While the retaining wall 36 provides advantages in preventing the two bodies 10, 12 from inadvertently separating from each other, the magnetic attraction between the magnets 42, 48 alone may suffice, so that the retaining wall 36 may be dispensed with. Alternatively, the retaining wall 36 may be used in tandem with complementary male and female connectors 52, 54 provided on the arm 32 and the body 12 to engage each other when the magnets 42, 48 contact each other. The male connector 52 preferably is an oblong peg attached to the bottom surface 44 of the body 12. The female connector 54 preferably is a complementary shaped orifice passing through the arm 32 at a location in alignment with the male connector 52 when the safety catch is in the closed position.

The male connector 52 and the female connector 54 are sized relative to each other so that the male connector 52 fits without tension within the female connector 54 in the catch position. This contrasts with conventional catch devices where pressure must be exerted to force a male connector into a female connector. This also contrasts with conventional catch devices that lock the male connector and the female connector together. Although such conventional catch devices may be employed if no magnetic attraction is used to maintain the catch in the catch position.

As an alternative, the female connector may be formed as a recess instead of an orifice. If desired, the male connector may be configured into a different shape other than as an oblong peg, provided the recess or orifice is configured to accommodate its insertion. Also, the female connector may be on the body 10 and the male connector may be on the arm 32.

FIGS. 9–12 show a further embodiment that is identical to the embodiment of FIGS. 1–8 except that the male connector 52 and the female connector 54 of FIGS. 1–6 are omitted.

As a further alternative to the embodiment of FIGS. 1–8, the retaining wall 36 may be dispensed with, but the complementary male and female connectors 52, 54 of FIGS. 1–8 remain together with the magnet pairs 22, 24 and 42, 48. As still a further alternative, only the magnet pairs 22, 24 and 42, 48 remain to enable opening and closing of the clasp, which means that both the retaining wall 36 of FIGS. 1–12 and the complementary male and female connectors 52, 54 are omitted.

The embodiment of FIGS. 2*a* and 2*b* differs from that of the embodiment of FIG. 1 by dispensing with the magnet 48 and arranging the magnet 55 and its holder 55*a* in a different position on the arm 32 than was the case for magnet 42 and holder 40, such that the magnet 55 aligns with the edges of the magnets 22, 24 to effect magnetic attraction when the arm 32 is moved from its release position to the catch position. Also, the arm 32 has a step 60, which may be curved as shown in FIG. 2*b*, to abut a peg 52*a* from the body 12. Thus, any tendency to pull the bodies 10, 12 apart while the arm is in the catch position will be resisted by the peg 52*a* acting against the body 12, while the magnet 55 keeps the arm in the catch position by magnetic attractive forces between the magnet 55 and the edges of the magnets 22, 24. If desired, magnet 55 may be replaced by a magnetically attracting surface.

Figure 2E:
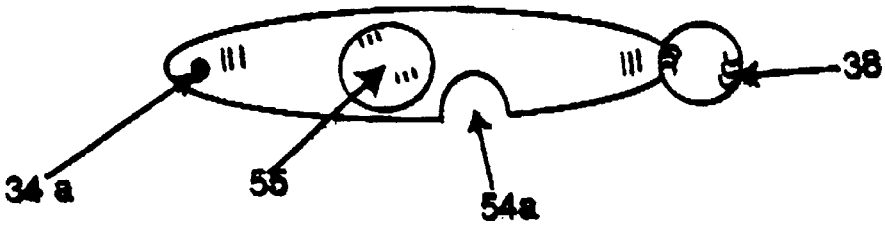
FIG. 2*e* shows a top plan view of an alternate embodiment of the arm of FIG. 2*c* in accordance with a further embodiment in which the side elevation view of this further embodiment with the arm of the safety catch secured in a closed condition would be identical to FIG. 2*d;*

The embodiment of FIG. 2*c* differs from the embodiment of FIG. 1 in that the arm 32 of FIG. 1 moves away from and toward the faces of bodies 10, 12 while the arm 32*a* of FIG. 2*c* moves sideways across the faces of the bodies 10, 12. Also, the hole 54 of FIG. 2 is replaced by a cut-out 54*a* that opens to the side. The embodiment of FIGS. 2*d* and 2*e* differ from the embodiment of FIG. 2*c* by eliminating the need for the magnet 48. Instead, the magnet 55 is moved on the arm to align with the edges of the magnets 22, 24 when the arm is in the closed condition. While the magnets 22, 24 need not have their sides exposed for the embodiment of FIG. 2*c*, exposure is necessary for the embodiment of FIGS. 2*d* and 2*e* to enable magnetic attraction with the magnet 55.

FIGS. 13–17 show another alternate embodiment of the invention. Instead of the retaining wall 36 being positioned to lie against the rear surface 20 of the body 12 when the arm 32 is in the catch position, the retaining wall 36 is positioned to lie within the body 12. Accordingly, body 12 includes a recess 60 that extends from the bottom surface 46 to the magnet 24. The recess 60 may be a hole in a portion of the body such that the two bodies 10,12 would need to be properly oriented for the arm to be placed into the catch position, or it may be a groove extending around the entire body 12 such that the arm could be placed into the catch position regardless of the orientation of the bodies 10,12. Those skilled in the art will recognize that if retainer wall 36 is replaced by a magnet or includes an additional magnet (not shown) that the recess 60 need not extend all the way to magnet 24, although it still could, so long as the body 12 is a magnetically attractive material such as iron, steel etc, or such a metal is located within the recess 60. As with the other embodiments, the retaining wall 36 may be any shape so long as it is capable of mating with recess 60. Further, while it is preferred that retaining wall 36 and recess 60 have the same general shape, it is not necessary.

When the arm 32 is in a catch position, the retaining wall 36 is in the most likely path that the body 12 would travel to separate from the body 10. The retaining wall 36 blocks the two bodies 10, 12 from inadvertently moving apart from each other. The blocking force exerted resists such movement because the opposite end of the arm 32 is secured by the hinge connection 34 to the body 10. Such a blocking force is in addition to the magnetic attraction afforded by the magnets 22 and 24 that also resist movement of the bodies 10, 12 away from each other. Also, the magnetic attraction between retaining wall 36 and magnet 24 oppose movement of the clasp in any less likely path that the body 12 would travel to separate from the body 10.

The foregoing specific embodiments of the present invention as set forth in the specification herein are for illustrative purposes only. Various deviations and modifications can be made within the spirit and scope of this invention, without departing from the main theme thereof.

What is claimed is:

1. A jewelry clasp, comprising:

two bodies movable between a separated condition and a connected condition;

the two bodies each having at least one magnetically attractive surface formed by a respective magnet;

the at least one magnetically attractive surface of each body being magnetically attracted to the other in the connected condition and being configured such that when the at least one magnetically attractive surface of each of the two bodies are brought together they align to a same orientation every time;

the two bodies being arranged to move into the separated condition in response to manual forces that pull the two bodies apart to break the magnetic attraction between the surfaces;

a safety catch, connected to one of the two bodies in one of a pivoted and hinged manner, that includes an arm movable between a catch position and a release position; and a male connector and a female connector arranged so that when the safety catch is in the closed position, the male connector is inserted into the female connector, the male connector being coupled to the are and the female connector being located within the other of the two bodies and the male connector being attracted to the other of the two bodies by a magnetic attraction as the safety catch moves between the release position and the catch position.

2. A jewelry clasp, comprising:

two bodies movable between a separated condition and a connected condition;

the two bodies each having at least one magnetically attractive surface;

the at least one magnetically attractive surface of each body being magnetically attracted to the other in the connected condition;

at least one of the magnetically attractive surfaces being formed by a magnet;

the two bodies being arranged to move into the separated condition in response to manual forces that pull the two bodies apart to break the magnetic attraction between the surfaces; and a safety catch, connected to one of the two bodies, that includes an arm movable between a catch position and a release position said arm further including a further magnetically attractive surface that is arranged and configured to be magnetically attracted to at least one of the magnet and the magnetically attractive surface as the arm reaches the catch position to effect further magnetic attraction and to break the further magnetic attraction as the arm leaves the catch position to enter the release position.

3. A jewelry clasp according to claim 2, wherein the further magnetically attractive surface includes another magnet.

4. A jewelry clasp according to claim 2, wherein the further magnetically attractive surface effects the further magnetic attraction with an edge of the magnet as the arm reaches the catch position.

5. A jewelry clasp according to claim 2, wherein one of the two bodies has an additional magnetically attractive surface arranged to effect the further magnetic attraction with the further magnetically attractive surface as the arm reaches the catch position.

6. A jewelry clasp according to claim 4, wherein the further magnetically attractive surface and the additional magnetically attractive surface each include respective magnets.

7. A jewelry clasp according to claim 1, wherein the safety catch has a retaining wall that extends from the arm and is arranged so that as the arm reaches the catch position, the retaining wall is in a path that the other of the two bodies could travel if the two bodies were to be pulled apart from each other to leave the connected condition, the retaining wall exerting a resisting force that blocks the other of the two bodies from reaching the separated condition.

8. A jewelry clasp according to claim 1, further comprising a retention member arranged on one of the arm and the one of the bodies to press against the other of the arm and the one of the bodies to provide resistance against separation between the two bodies as the arm remains in the catch position.

9. A jewelry clasp according to claim 1, wherein the arm has a free end spaced from the two bodies to permit a fingernail to be placed against the free end to exert a manual force in a direction that breaks the further magnetic attraction.

10. A jewelry clasp according to claim 9, further comprising a ball secured at the free end and arranged to be at a spatial location that is beyond a periphery of the one of the two bodies so that the fingernail may move the ball and thereby the free end of the arm in a direction away from the one of the two bodies.

11. A jewelry clasp according to claim 1, wherein each of the two bodies has a side facing away from each other, further comprising a respective half ring connected to each of the sides.

12. A jewelry clasp according to claim 1, further comprising a hinge connection that connects the arm to the other of the two bodies to permit the arm to swing about the hinge connection between the catch position and the release position.

13. A jewelry clasp according to claim 1, further comprising two blocking surfaces arranged to abut against each other as the safety catch is in the closed position to resist forces that arise that tend to separate the two bodies from each other, one of the abutting surfaces being formed on the arm and the other of the abutting surfaces being formed on one of the two bodies, the abutting surfaces being free from being locked to each other when the safety catch is in the catch position and being free from being under tension as the safety catch moves between the release position and the catch position.

14. A method of operating a jewelry clasp that includes two bodies and a safety catch connected to one of the two bodies in one of a pivoted and hinged manner, comprising opening and closing the jewelry clasp, the opening including releasing the safety catch from a catch position to thereby reach a release position by moving the safety catch in the one of the pivoted and hinged manner and then breaking a magnetic attraction between the two bodies of the jewelry clasp by manually pulling the two bodies apart from each other, the closing including bringing the two bodies together to restore the magnetic attraction between the two bodies by contact, and then returning the safety catch from the release position to the catch position, the two bodies aligning to a same orientation every time the two bodies are brought together because each of the two bodies has at least one magnetically attractive surface formed by a magnet that are configured so that they align to a same orientation every time each of the at least one magnetically attractive surface of each of the two bodies are brought together, blocking the two bodies from separating from each other by moving a retaining wall arranged on the safety catch into a path that the other of the two bodies could travel to separate from the one of the two bodies, unblocking the two bodies by moving the retaining wall out of the path, further blocking the two bodies from separating from each other by forming a magnetic attraction between the retaining wall and the other of the two bodies.

15. A method of operating a jewelry clasp that includes two bodies, comprising opening and closing the jewelry clasp, the opening including releasing a safety catch from a catch position to thereby reach a release position and then breaking a magnetic attraction between the two bodies of the jewelry clasp by manually pulling the two bodies apart from each other, the closing including bringing the two bodies together to restore the magnetic attraction between the two bodies by contact, and then returning the safety catch from the release position to the catch position the releasing a safety catch from a catch position to reach a release position further including breaking a further magnetic attraction between an arm and the clasp and the returning the safety catch from the release position to the catch position further includes restoring the further magnetic attraction between the arm and the clasp by contact.

16. A method according to claim 14, further comprising blocking the two bodies from separating from each other by abutting two blocking surfaces against each other, one of the abutting surfaces being formed on an arm of the safety catch and the other of the abutting surfaces being formed on one of the two bodies, the abutting surfaces being free from being under tension as the arm moves between the release position and the catch position and being free from being locked to each other while the arm is in the catch position.

17. A method according to claim 14, wherein the returning the safety catch from the release position to the catch position further includes positioning a retention member to block the two bodies from separating from each other.

18. A method as in claim 14, wherein the safety catch includes an arm and the arm has a free end spaced from the two bodies, the releasing arising by placing a fingernail against the free end and then exerting with the fingernail a manual force in a direction that breaks the further magnetic attraction.

19. A method according to claim 18, wherein the exerting includes flicking a ball secured at the free end and that is arranged at a spatial location beyond a periphery of the other of the two bodies, the flicking causing the arm to pivot about a hinge connection, the hinge connection being secured to the arm and to the other of the two bodies.

20. A method according to claim 19, wherein the moving of the arm between the release and the catch positions includes rotating the arm about the hinge connection.

21. A method according to claim 14, further comprising blocking the two bodies from separating from each other by inserting a male connector into a female connector and unblocking the two bodies by removing the male connector from the female connector.

22. A method according to claim 21, wherein the inserting is carried out without tensioning either the male connector or the female connector and without locking the male connector into the female connector.

* * * * *